US005101857A

United States Patent [19]

Heger et al.

[11] Patent Number: 5,101,857

[45] Date of Patent: Apr. 7, 1992

[54] VALVE VANE

[75] Inventors: Werner Heger, Lehrte; Wolfgang Kaltenthaler; Heinrich Schlossarczyk, both of Wennigsen, all of Fed. Rep. of Germany

[73] Assignee: WABCO Westinghouse Fahrzeugbremsen GmbH, Hanover, Fed. Rep. of Germany

[21] Appl. No.: 478,249

[22] Filed: Feb. 9, 1990

[30] Foreign Application Priority Data

Feb. 11, 1989 [DE] Fed. Rep. of Germany ..... 3904172

[51] Int. Cl.[5] ..... F04B 49/00

[52] U.S. Cl. ..... 137/599; 251/58; 251/301; 417/298; 417/307

[58] Field of Search ..... 417/307, 440, 298; 137/855, 856, 599; 251/58, 300, 301

[56] References Cited

U.S. PATENT DOCUMENTS 4,522,568 6/1985 Gelse ..... 417/307
4,932,631 6/1990 Heger ..... 251/58

FOREIGN PATENT DOCUMENTS 3329790 2/1985 Fed. Rep. of Germany .
3642852 6/1988 Fed. Rep. of Germany .

*Primary Examiner*—Robert G. Nilson
*Attorney, Agent, or Firm*—Horst M. Kasper

[57] ABSTRACT

A valve vane is provided, where the valve vane is movable along the surface of a casing part and is driven by a dog follower, guided in a slot of the casing part, wherein the slot is furnished at least at one end, and wherein a flat slider is required for a sealing of the casing part. Such a flat slider requires by itself a substantial structure. The invention valve vane (6) is structured such that it covers the slot (12) in each phase of its motion. The invention structure is particularly suitable for being employed in a inlety valve system of a compressor.

20 Claims, 4 Drawing Sheets

VALVE VANE

BACKGROUND OF THE INVENTION

1. Field of the Invention

The invention relates to a valve vane which is movable along the surface of a casing part at least one end, which is called a moving end, in a direction substantially transverse to its longitudinal direction between two end positions.

2. Brief Description of The Background of The Invention Including Prior Art

Such a valve vane is known from the German Patent Application Laid Open DE-OS 3,329,790 Al. For the purpose of preventing the entering of work medium and impurities through the casing slot into the casing part and of thereby increasing the operating safety of, for example, the device elements disposed in the casing part, the reference teaches that the casing slot is sealed relative to the surface of the casing part by a flat slider, compare page 14, line 19, of the reference. The flat slider is formed such that it serves at the same time for transmission of the drive force from the dog follower to the valve vane. For this purpose, there is formed on or attached at the flat slider a receiver for a dog follower and a pin for an engaging of the dog follower at the valve vane which is an expensive construction.

SUMMARY OF THE INVENTION

1. Purposes of the Invention

It is an object of the invention to furnish a valve vane of the initially recited kind in a simple structure and further to improve such structure such that it does not require an additional sealing element.

It is another object of the present invention to provide a valve vane in a structure which avoids contamination.

It is a further object of the invention to increase the safety and reliability of a valve vane.

These and other objects and advantages of the present invention will become evident from the description which follows.

2. Brief Description of the Invention

The present invention provides for a valve structure. A casing part has an elongated slot designated hereinafter as casing slot. A valve vane has a first end and a second end and is movable along the surface of the casing part at its first end, in a direction substantially transverse to a longitudinal extension of the valve vane between two limiting positions A, B. The valve vane is expanded at the first end substantially transverse to its longitudinal extension to at least double the length of the casing slot. The depth of the expansion in direction of the longitudinal extension of the valve vane is in this direction at least equal to the maximum width of the outer contour of the casing slot. The valve vane can be brought sealingly into contact with at least the surface area of the casing part surrounding the casing slot. A dog follower is attached in the area of the first end of the valve vane and guided in the casing slot for transmitting a motion to the valve vane. The point of engagement of the dog follower rests on a bisectrix H intersecting the extension of the valve vane at the middle of the extension. The dog follower can be attached directly at the valve vane.

The casing slot can follow a straight line. The motion of the valve vane can be a substantially swivelling motion, according to the double arrow S around a swinging pin engaging at the second end of the valve vane. The valve vane can exhibit a guide slot or a guide groove, extending substantially in direction of the longitudinal extension of the valve vane, for the receiving of a swinging pin. In this case, the length L of the guide slot or the guide groove can be at least equal to the relative path between the swinging pin and the valve vane during the motion of the valve vane from the one limiting position A or, respectively, B into the second limiting position B or, respectively, A in addition to the swinging pin dimension a in the longitudinal direction of the guide slot The motion of the valve vane can be represented by a parallel shifting, according to double arrow V, substantially transverse to the longitudinal extension of the valve vane. The valve vane can be expanded on its two ends and can engage at a first one of the two ends said dog follower and at a second one of the two ends a further dog follower.

A cap can be connected to the valve vane. The dog follower can be guided by a breakout of the valve vane and the breakout can be closed pressure-sealingly with the cap.

The valve vane can cover at least one opening in the casing part under formation of a valve in the one limiting position A of the valve vane. This opening can be released in the second limiting position B of the valve vane.

A pressure-activated control cylinder can be disposed in the casing part and can control the motion of the valve vane. Said dog follower can form a part of the pressure-activated control cylinder.

At least the surface region of the casing part, passed over by the valve vane during motion of the valve vane, can be recessed into the casing part, relative to the surrounding surface of the casing part by a depth corresponding to at least the thickness d of the valve vane.

The valve vane can be covered on its side, disposed remote from the casing part, at least over one part, of its longitudinal extension, by a further valve vane. The further valve vane can form a further valve with at least one further opening disposed in the surrounding surface of the casing part. Said further valve can exhibit in a foundation projection an inner surface recess. The opening of the valve can be disposed within said inner surface recess.

The valve vane can be covered on its side, disposed remote from the casing part, at least over one side part, of its longitudinal extension, by a further valve vane. The further valve vane can form a further valve with at least one further opening disposed in the surrounding surface of the casing part. Said further valve can exhibit in a foundation projection an inner surface recess. The opening of the valve can be disposed within said inner surface recess.

Similar to the sealing element of the German Patent Application Laid Open DE-OS 3,329,790 Al, the invention valve structure allows to increase the delivery rate when used in a compressed gas generator.

The invention valve structure further allows that the slot in the casing can have an arbitrary shape in its longitudinal direction. The slot can be of a straight-line shape, it can be uniformly curved, but alternatively it can also be of a meander shape.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
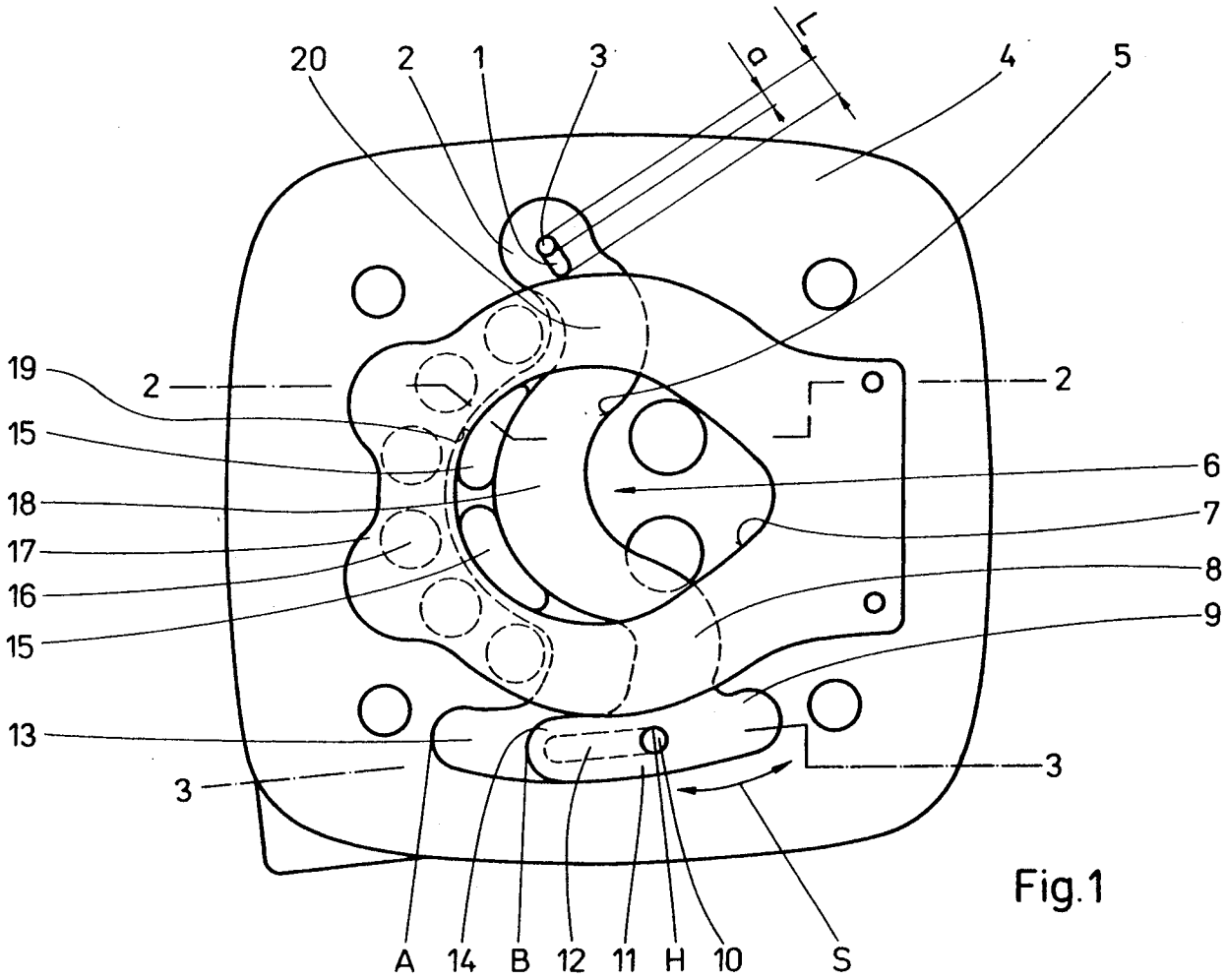
FIG. 1 is a top planar view of a structure with a valve vane.
Figure 2:
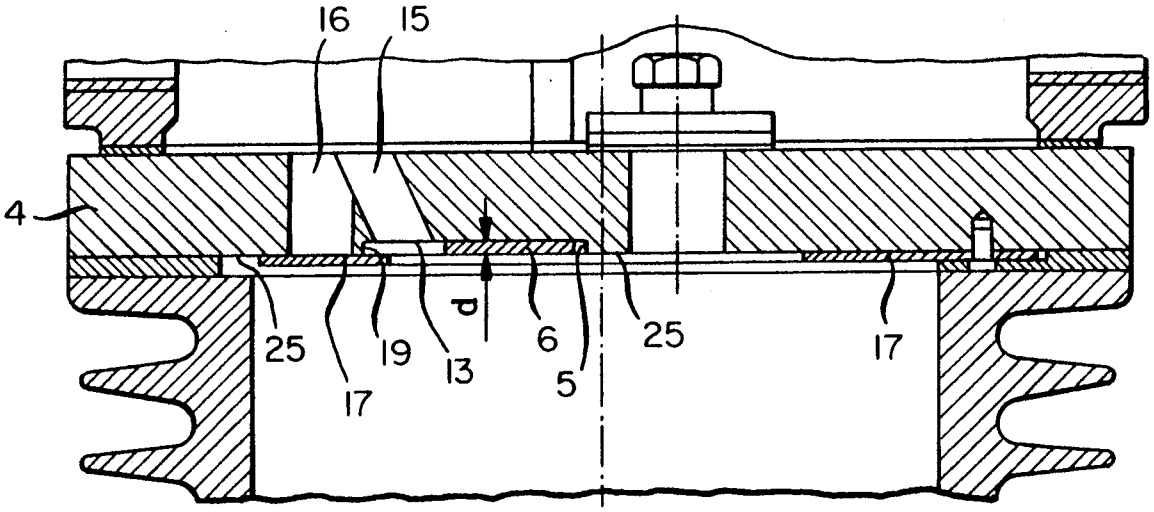
FIG. 2 is a view of an enlarged section along section line 2—2 through the embodiment according to FIG. 1.
Figure 3:
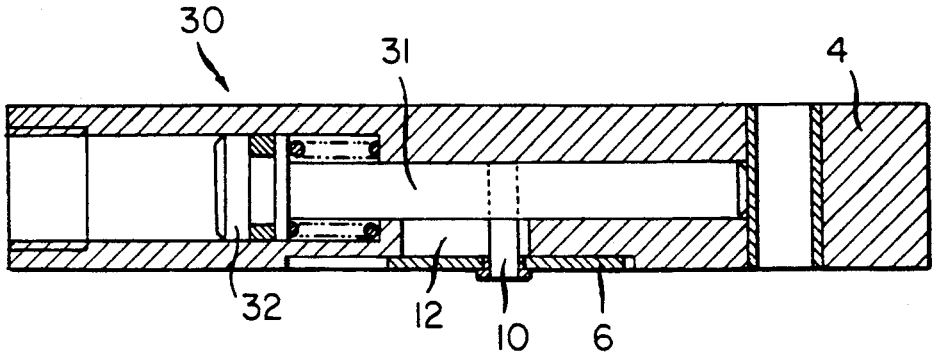
FIG. 3 is a view of an enlarged section along section line 3—3 through the embodiment of FIG. 1.

The reference numerals in the following are employed such that the same numerals refer to structural parts performing the same function. In the following, the exemplified embodiment of FIGS. 1 to 3 is described without continuous reference to the figure number.

According to the present invention, there is provided a valve vane 6, 51. Said valve vane 6, 51 is movable along the surface of a casing part 4 at least at one end, designated in the following as movable end 11, 50, 52, in a direction substantially transverse to the longitudinal extension of the valve vane between two end positions A, B. A dog follower 10 is provided, guided in a slot of the casing part, designated hereinafter as casing slot 12, and disposed at the movable end 11, 50, 52 of the valve vane for generating of the motion. The valve vane 6, 51 is expanded at the movable end 11, 50, 52 substantially transverse to its longitudinal extension to at least double the length of the casing slot 12. The point of engagement of the dog follower 10 rests on the bisectrix H of the double length. The depth of the expansion in direction of the longitudinal extension of the valve vane 6, 51 is in this direction at least equal to the maximum width of the outer contour of the casing slot 12. The valve vane 6, 51 can be brought sealingly into contact with at least the surface area of the casing part 4, surrounding the casing slot 12. The dog follower 10 can engage directly at the valve vane 6, 51.

The casing slot 12 can follow a straight line. In this case the motion of the valve vane 6 can be substantially a swivelling motion according to the double arrow S around a swinging pin 3 engaging at the second end 2 of the valve vane 6. The valve vane 6 can exhibit a guide slot 1, extending substantially in direction of the longitudinal extension of the valve vane. Alternatively, the valve vane 6 can exhibit an equidirected guide groove, for the receiving of the swinging pin 3. The length L of the guide slot or, respectively, of the guide groove can be at least equal to the relative path between the swinging pin 3 and the valve vane 6 during the motion of the valve vane 6 from the one end position A or, respectively, B into the second end position B or, respectively, A, in addition to the swinging pin dimension a in the longitudinal direction of the guide slot 1 or, respectively, of the guide groove.

The motion can be a parallel shifting, according to double arrow V, substantially transverse to the longitudinal extension of the valve vane 51. The valve vane 51 can be expanded on its two ends 50, 52 and an can engage, in each case, a dog follower 10 at the two ends 50, 52. The dog follower 10 can be received by a breakout of the valve vane 6, 51. The breakout can be closed pressure-sealingly with a cap connected to the valve vane 6, 51. The valve vane 6, 51 can cover at least one opening 15 in the casing part 4 under formation of a valve 6, 15, 51, 15 in the one end position A. This opening 15 can be opened in the second end position B. The dog follower 10 can be part of a pressure-activated control cylinder 30, disposed in the casing part 4 and controlling the motion of the valve vane 6.

At least the surface region 13, passed over by the valve vane 6 during motion of the valve vane 6, of the casing part 4 can be recessed into the casing part 4, relative to the surrounding surface 25 of the casing part 4 by a measure corresponding to at least the thickness d of the valve vane 6. The valve vane 6, 51 can be covered on its side, disposed remote from the casing part 4, at least over one part, such as side parts 8, 20, of its longitudinal extension, by a further valve vane 17. The valve vane 17 can form a further valve 16, 17 with at least one further opening 16, disposed in the surrounding surface 25 of the casing part 4. The further valve 17 can exhibit in the foundation projection an inner surface recess 7. The opening 15 of the valve 6, 15 51, 15 can be disposed within said inner surface recess 7.

The embodiment illustrated comprises a casing part 4 and valve vane generally designated with the reference numeral 6. The elongated valve vane 6 comprises a center part 18, two side parts 8, 20 disposed on opposite sides of the center part 18 as well as two ends 2, 11 following tc the side parts 8, 20.

As illustrated by a double arrow S, the valve vane 6 is supported at the casing part 4 and can be swivelled along the surface of the casing part 4. During the swivelling motion, the one end, designated in the following as the movable end 11, of the valve vane 6 is moved substantially transverse relative to the longitudinal extension of the valve vane 6 between the two end positions A, B. For a generation of this motion, a dog follower 10 engages at the movable end 11, which dog follower 10 is guided in a slot of the casing part 4, which slot is designated in the following as casing slot 12.

The valve vane 6 exhibits at the movable end 11 a receiver section, for example, a breakout or an indentation, for the dog follower 10 such that the dog follower 10 engages the valve vane 6 directly.

The support of the valve vane 6 is formed such that, at its second end 2, there engages a swinging pin 3, which is anchored in a conventional fashion in the casing part 4. The valve vane 6 exhibits for the swinging pin 3 at the second end 2 a receiver formed in a conventional manner, for example a breakout or an indented part.

The casing slot 12 can have any desired course It can be a straight-line slot, it can be a uniformly curved slot, but it can also be a meander-shaped slot. The casing slot 12 has to have a sufficient length in order to allow for the motion of the movable end 11 of the valve vane 6 between the end positions A, B. The casing slot 12 can alternatively be constructed such and be disposed such that it fixes the end positions A, B based on its length.

The valve vane 6 is, at its movable end 11, expanded to twice or more the length of the casing slot 12, in a direction substantially transverse to the longitudinal extension of the valve vane 6, i.e. its length substantially in the direction of the connection line between the receivers for the follower dog 10 and the swinging pin 3, i.e substantially in the direction of the motion between the end positions A, B. This feature is expressed in FIG. 1 by way of the hammer-like projection on a horizontal plane of the movable end 11 with lateral extensions 9, 14. The expansion, or more precisely, the extensions 9, 14, are disposed such in the receiver of the dog follower 10 that the engagement point of the dog follower 10, i.e. the geometric center of the dog follower 10, is disposed on the bisectrix H of the double length. If the expansion is disposed symmetrically around the bisectrix H, i.e. if the extensions 9, 14 are disposed symmetrically around the bisectrix H, then the bisectrix H is also the bisectrix of the expansion.

The depth of the expansion or, more precisely, the extensions 9, 14 is at least equal to the maximum width of the outer contour of the casing slot 12. In this context, the depth of the expansion or, respectively, the width of the casing slot 12 is deemed to be their outer dimensions essentially in direction of the longitudinal extension of the valve vane 6. In this case, the width of the casing slot 12 is to be considered the distance, which exhibits the points disposed most spaced apart from each other of the outer contour of the casing slot in this direction. In case of a straight casing slot, running tangential to the swivelling radius of the valve vane 6, the above-defined width corresponds substantially to the width of the casing slot itself.

The valve vane 6 or, more precisely, the movable and expanded end 11 of the valve vane 6, can be brought sealingly into contact with the surface region of the casing part 4 surrounding the casing slot. For this purpose, this surface region and the surface, facing the surface region, of the valve vane 6, or, more precisely, the movable part 11 of the valve vane 6, are constructed and machined such that, in case of a correspondingly high pressure application of the movable end 11 to the considered surface region of the casing part 4, there is generated a sealing effect. Depending on the application situation, the pressure or tightening can be provided, for example, by the elasticity or spring force of the valve vane 6 itself, or by an outer spring, a mechanically induced pressure or by application of pressure to the valve vane 6 on its face disposed remote to the casing part 4. However, the pressure or tightening can also be provided by combination of the aforementioned possibilities.

Based on the features described so far, the valve vane 6 continuously seals at its movable end 11 the casing slot 12 in each end position A or, respectively, B and in each intermediate position such that an additional sealing element becomes superfluous.

Outside of the surface region of the casing pat 4 surrounding the guiding casing slot 12 upon the swivelling of can maintain a distance with respect to the surface of the casing part 4 or can slide on said surface. The valve vane 6 can also be brought in sealing contact additionally with other surface regions. This will be made reference to later on. The latter-recited development is facilitated by a preferred embodiment of the valve vane 6. In this case the valve vane 6 is made out of band metal, planar surface ground on one or two sides, in particular spring band steel.

According to the embodiment there are illustrated further developments of the invention to which reference is made in the following.

The casing slot 12 runs along a straight line, i.e. the dog follower 10 is guided in a straight line. The paths of motion of the dog follower 10 and of its receiver in the movable end 11 of the valve vane 6 are different, whereby a side force is generated which endangers the device parts of the embodiment. In order to avoid such a side force, the receiver for the swinging pin 3 at the other end 2 of the valve vane 6 is formed as guide slot 1, substantially running in direction of the longitudinal extension of the valve vane 6, or as an equidirectional guide groove. In this case, the length L of the guide slot 1 or of the guide groove, is equal to the relative path between the swinging pin 3 and the valve vane 6, or more precisely at the second end 2 of the valve vane 6, where, during the motion of the valve vane 6 from the one end position A or, respectively, B into the second end position B or, respectively, A in addition to the swinging pin dimension a in the longitudinal direction of the guide slot 1 or, respectively, of the guide groove. During the motion of the movable end 11 between the end positions A, B, the second end 2 of the valve vane 6 moves in direction of the guide slot 1 or, respectively, the guide groove around the swinging pin 3. The valve vane 6, during the motion of its movable end 11 between the end positions A, B, thus does not perform a pure swivelling motion but a mixed motion, made up of a swivelling and a translatory motion, substantially in direction of its longitudinal extension.

The casing part 4 comprises openings 15 within the surface region, passed over during the swivelling by the valve vane 6 and designated with the area reference numeral 13 and the contour reference numerals 5 and 19. The surface region of the casing part 4, surrounding each opening 15, and the coordinated surface region of the valve vane 6 are formed and constructed such that they can be brought sealingly into contact by a sufficiently high pressure application. This can be achieved in a simple fashion in that either the total surface region 13, 5, 19 or even the total surface of the casing part 4 are correspondingly processed and finished and the valve vane 6, as indicated above, is surface ground on at least the face disposed toward the casing part 4. The above recited descriptions with respect to the sealing of the casing slot 12 hold correspondingly also for the generation of the pressure application. The valve vane 6 covers in its end position A the openings 15 and releases these openings in the second end position B. The valve vane 6 thus forms with the openings 15 a valve 6, 15. This valve is, precisely defined, a double valve, since the valve vane 6 can also release the openings 15 in the end position A, i.e. by lifting off of the valve vane 6 from the openings 15 in case of lack of sufficient pressure application It is evident that instead of several openings 15, only one opening 15 can also be provided with the same effect.

Within the above-described basic perimeter, the valve vane 6 can move in front of or, respectively, slide on the surface of the casing part 4, disposed toward the valve vane 6. In this case, the construction height of the illustrated arrangement is, by at least the thickness d of the valve vane 6, larger than that of the casing part 4.

According to a further feature of the embodiment, for the purpose of saving of construction height and for the preparation of further embodiments, which are explained in more detail below, the surface region 13, 5, 19, passed over by the valve vane 6 during the motion of the valve vane 6, is recessed into the casing part 4 by the thickness d of the valve vane 6 relative to the surrounding surface 25 of the casing part 4. FIG. 2 illustrates this feature. The surrounding surface is designated with reference numeral 25 in FIG. 2. The surface region 13, 5, 19 is recessed by the thickness d relative to the surrounding surface 25. It is to be understood that, in this case, the thickness tolerances of the valve vane and the clearance required for achieving its free passage and movement, have to be taken into consideration. It is also to be understood that the countersink in the casing part 4 can be larger than the surface region 13, 5, 19 passed over by the valve vane 6.

The structure described in the preceding paragraph is further modified by a disposition of a further valve vane 17 on the surface 25 surrounding the surface region 13, 5, 19. According to the projection on a horizontal plane of this structure, several openings 16 emanate from the surface 25, surrounding the surface region 13, 5, 19. The further valve vane 17 forms a further valve 16, 17 with the several openings 16. The further valve vane 17 exhibits in the projection on a horizontal plane an inner surface recess, the contour of which is designated in the following with the reference numeral 7. The openings 15 are disposed within said inner surface recess 7, such that the passage of the valve 6, 15 through the further valve vane 17 is not interfered with. The surface recess 7 is of such dimensions that further openings or other device elements can be disposed in the casing part 4 within the surface recess 7, however, this will not be described in more detail. Relative to these openings or, respectively, the other device elements, the openings 15 are disposed at the periphery of the surface recess 7 and formed, in the projection on a horizontal plane, in a crescent-shaped cross-section. The center part 18 of the valve vane 6 is also crescent shaped. The center part 18 is placed substantially or fully exposed within the surface recess 7 such that the further valve vane 17 only partly covers the valve vane 6, in particular at its side parts 8, 20. It is understood that, barring other viewpoints, the further valve vane 17 can also cover larger parts of the valve vane 6. As a result of the covering, the valve vane 6 receives, based on the further valve vane 17, a certain guidance; a "certain guidance" because the further valve vane 17, during the opening of the valve 16, 17, lifts from the surrounding surface 25, and thereby permits the valve vane 6 to lift from the opening 15 and also open the valve 6, 15, not only by a pivoting of the valve vane 16, but also by lifting of the valve vane 6. It is obvious that the preceding statements apply correspondingly to the valve 16, 17 when only one opening 16 is furnished.

FIG. 3 illustrates a device disposed in the casing part 4 to drive the dog follower 10 and consequently to move the valve vane 6. The device comprises a pressure-activated control cylinder, designated with reference numeral 30, including a piston 32, a piston rod 31 attached at the piston 32, and a dog follower 10 as a further component. The piston rod 31 is provided as a rigid structure, and for this purpose this device requires a straight casing slot 12. A differently shaped casing slot 12 would require either a different design of the device or a flexible piston rod, for example, a piston rod with a hinge.

Figure 4:
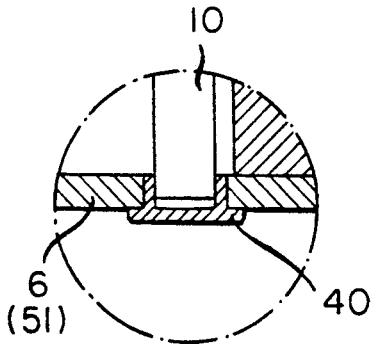
FIG. 4 is an enlarged detail view of the embodiment of FIG. 3.

FIG. 4 illustrates an advantageous embodiment of the receiver for the dog follower 10 in the valve vane 6. The receiver comprises in this case a breakout, in the valve vane 6 not described in detail. This breakout is closed by a cap 40 on the side of the valve vane 6 that is averted from the dog follower, said cap 40 is connected pressure-tight with the valve vane 6. This structure is particularly advantageous insofar as it assures a sealed engagement between the dog follower 10 and the valve vane 6, while at the same time avoiding an expensive and possibly difficult structure of the valve vane 6. This structure is particularly difficult when the valve vane 6 is made of a high-strength and/or brittle material, depending on the field of application.

Figure 5:
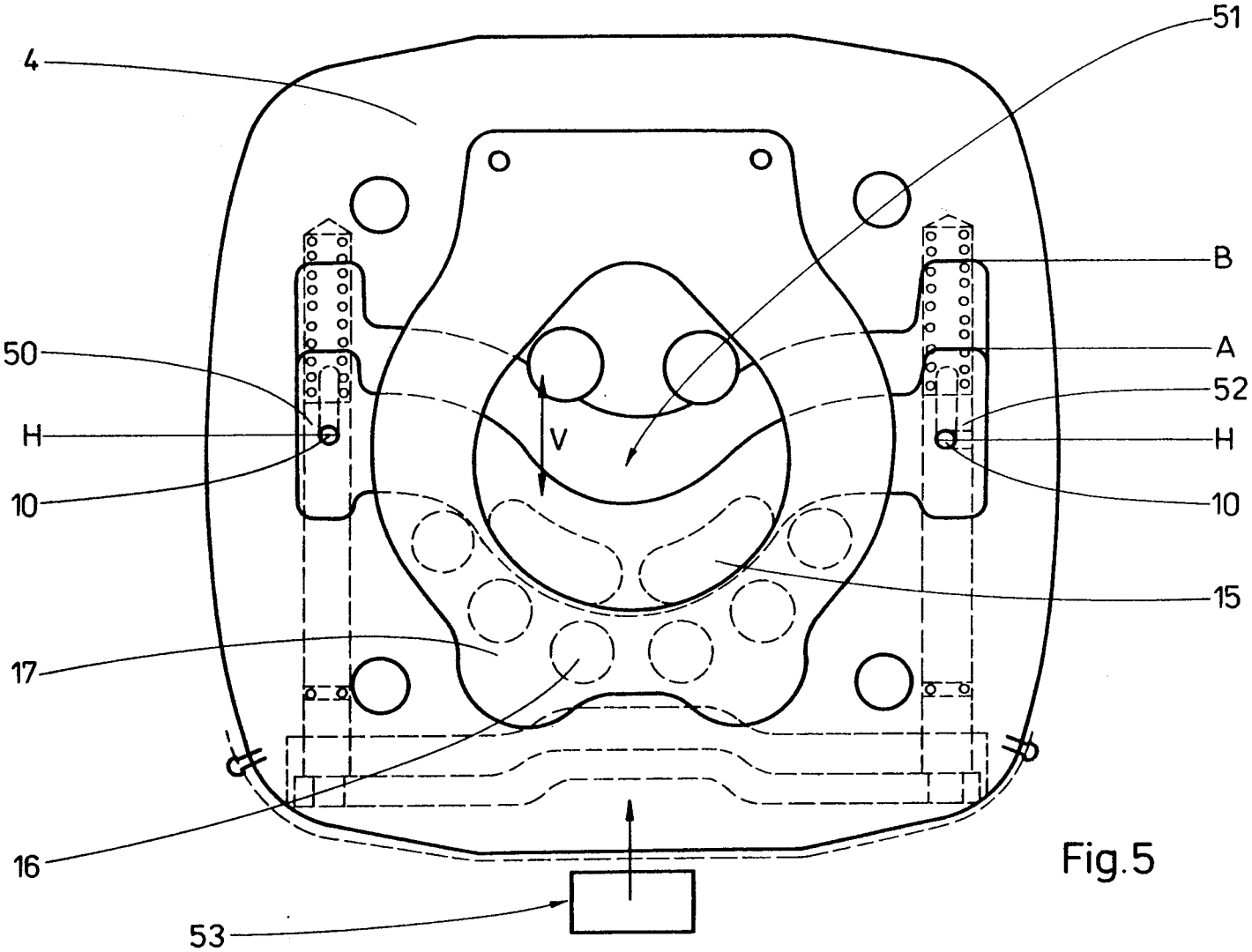
FIG. 5 is a top plan view onto a further embodiment including a valve vane.

The embodiment according to FIG. 5 illustrates a structure with a valve vane 51, which is movable substantially transverse to its longitudinal extension, as illustrated by a double-ended arrow V. In this case, the two ends 50, 52 of the valve vane 51 move between the end positions A, B. At the two ends 50, 52 engages, in each case, a dog follower 10 which, in each case, is guided again along a straight line in a casing slot 12. In this case, the two ends 50, 52 of the valve vane are formed in a corresponding application of the above recited description relative to the movable end 2 of the preceding embodiment. The arrangement for driving of the valve vane 51 is only roughly indicated and is generally designated with 53.

Otherwise, all statements made relative to the preceding embodiments apply to this embodiment as well as in an appropriate manner the discussed possibilities for further development, as suggested, for example, in FIGS. 2 and 4 by the bracketed reference numerals from FIG. 5.

The illustrated structures can be employed advantageously in their basic scope and in the modified embodiments as a cylinder end section of a compressor, in particular of an air compressor. The valve vanes 6 or, respectively, 51 and, if existing, the further valve vane 17 are disposed in this application situation in the compression chamber, whereby the pressure application of the valve vane against the housing is accomplished by the compression pressure, possibly in connection with the elasticity of the valve vane. Together with respective openings in the casing part 4 the valve vane 6, 51 form the intake valve or, respectively, the intake valves or, respectively, an intake valve system of the compressor. The property of the valve 6, 15 to open, on the one hand, by the lift of the valve vane 6 and, on the other hand, by a pivoting of the valve vane 6, is in this application particularly advantageous because of its opening by the lift of the valve vane 6 that results from the action of the suction upon filling of the compressor in normal operation and because of its opening by pivoting the valve vane 6 for purposes of automatic control. According to an advantageous arrangement, the valve vane 6 or, respectively, 51 can, for this application, cross about diametrically the compression cylinder, and its ends can protrude in an about radial direction from the perimeter of this cylinder.

The dog follower 10 can be positioned on the valve vane 6, 51 such that, independent of the position in the slot, the extension of the valve vane will cover the slot. Preferably, the width of an extension covering the slot is from about 2 to 4 times, and preferably from about 2.5 to 3.5 times the width of the slot. The length of the extension is preferably from about 2.1 to 3 times, and preferably from about 2.2 to 2.4 times the length of the slot. The diameter of the pin substantially matches the diameter of the slot leaving a small clearance for allowing shifting.

A person skilled in the art recognizes that the types and directions of motion of the valve vane were chosen as representative of all possible types of movement which can be performed with the invention structure.

It will be understood that each of the elements described above, or two or more together, may also find a useful application in other types of valve vanes differing from the types described above.

While the invention has been illustrated and described as embodied in the context of a valve structure which does not require an additional sealing element, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A valve structure comprising a casing part having an elongated slot designated hereinafter as casing slot;

a valve vane having a first end and a second end and movable along the surface of the casing part at its first end, in a direction substantially transverse to a longitudinal extension of the valve vane between two limiting positions (A, B) and wherein the valve vane is enlarged at the first end substantially transverse to the longitudinal extension of the valve vane to at least double the length of the casing slot, wherein the width of the enlargement in direction of the longitudinal extension of the valve vane is at least equal to the maximum width of the outer contour of the casing slot, and wherein the valve vane can be brought sealingly into contact with at least the surface area of the casing part surrounding the casing slot such that the enlargement covers the casing slot in all positions of the valve vane; and a dog follower attached to the enlargement and guided in the casing slot for transmitting a motion to the valve vane, wherein the point of engagement between the dog follower and valve vane is disposed substantially in the middle of the double length.

2. The valve structure according to claim 1, wherein the dog follower is attached directly at the valve vane.

3. The valve structure according to claim 1, wherein the casing slot follows a straight line, and wherein the motion of the valve vane is substantially a swivelling motion around a pin engaging the second end of the valve vane;

wherein the valve vane exhibits a guide slot for engaging the pin, the guide slot extends substantially in the direction of the longitudinal extension of the valve vane.

4. The valve structure according to claim 1, wherein the casing slot follows a straight line and wherein the motion of the valve vane is substantially a swivelling motion (according to the double arrow S) around a pin engaging at the second end of the valve vane;

wherein the valve vane includes a guide groove, extending substantially in direction of the longitudinal extension of the valve vane for the receiving of the pin.

5. The valve structure according to claim 1, wherein the motion of the valve vane is represented by a parallel shifting (according to double arrow V) substantially transverse to the longitudinal extension of the valve vane, and wherein the valve vane is expanded on its two ends and engages at a first one of the two ends said dog follower and at a second one of the two ends a further dog follower.

6. The valve structure according to claim 1 further comprising a cap connected to the valve vane, wherein the dog follower is guided by a breakout of the valve vane and wherein the breakout is closed pressure-sealingly with the cap.

7. The valve structure according to claim 1, wherein the valve vane covers at least one opening in the casing part under formation of a valve in the one limiting position (A) of the valve vane, and wherein this opening is released in the second limiting position (B) of the valve vane.

8. The valve structure according to claim 1 further comprising a pressure-activated control cylinder disposed in the casing part and controlling the motion of the valve vane, wherein said dog follower forms a part of the pressure-actuated control cylinder.

9. The valve structure according to claim 1, wherein at least the surface region of the casing part, passed over by the valve vane during motion of the valve vane, is recessed into the casing part, relative to the surrounding surface of the casing part by a depth corresponding to at least the thickness (d) of the valve vane.

10. The valve structure according to claim 9, wherein the valve vane is covered on its side, disposed remote from the casing part, at least over one part, of its longitudinal extension, by a further valve vane, which further valve vane forms a further valve with at least one further opening disposed in the surrounding surface of the casing part, and wherein the further valve exhibits in a foundation projection an inner face recess, wherein the opening of the valve is disposed within said inner face recess.

11. The valve structure according to claim 9, wherein the valve vane is covered on its side, disposed remote from the casing part, at least over one side part, of its longitudinal extension, by a further valve vane, which further valve vane forms a further valve with at least one further opening disposed in the surrounding surface of the casing part, and wherein the further valve exhibits in a foundation projection an inner face recess, wherein the opening of the valve is disposed within said inner face recess.

12. A valve vane (6, 51) having a movable end, along the surface of the casing part (4), called in the following as movable end (11, 50, 52), in a direction substantially transverse to the longitudinal extension of the valve vane between two end positions (A, B), where a dog follower (10) is provided for the generating of the motion and is guided in a slot (12) of the casing part, and wherein said dog follower is disposed at the movable end (11, 50, 52) of the valve vane, wherein a) the valve vane (6, 51) has an enlargement at its movable end which enlargement is (11, 50, 52) substantially transverse to the longitudinal extension of the valve vane and is at least double the length of the casing slot (12), the point of engagement of the dog follower (10) is disposed substantially at the middle of the double length, b) the width of the enlargement in the longitudinal direction of the valve vane (6, 51) is at least equal to the maximum width of the outer contour of the casing slot (12) such that the enlargement covers the casing slot (12)in all positions of the valve vane and c) the valve vane (6, 51) can be brought sealingly into contact with at least the surface area of the casing part (4), surrounding the casing slot (12).

13. The valve vane according to claim 12, wherein the dog follower (10) engages directly at the valve vane (6, 51).

14. The valve vane according to claim 12, wherein the casing slot (12) follows a straight line and wherein the motion of the valve vane (6) is substantially a swivelling motion according to the double arrow S around a pin (3) engaging at the second end (2) of the valve vane (6), wherein the valve vane (6) exhibits a guide slot (1), extending substantially in direction of the longitudinal extension of the valve vane, or which valve vane (6) exhibits an equidirected guide groove, for the receiving of the pin (3), where the length (L) of the guide slot or, respectively, of the guide groove is at least equal to the arc covered by the pin (3) of the valve vane (6) during the motion of the valve vane (6) from the one end position (A or, respectively, B) into the second end position (B or, respectively, A).

15. The valve vane according to claim 12, wherein the motion is a parallel shifting (according to double arrow V) substantially transverse to the longitudinal extension of the valve vane (51), wherein the valve vane (51) is expanded on its two ends (50, 52) and engages at the two ends (50, 52) in each case a dog follower (10).

16. The valve vane according to claim 12, wherein the dog follower (10) is received by a breakout of the valve vane (6, 51), wherein the breakout is closed pressure-sealingly with a cap connected to the valve vane (6, 51).

17. The valve vane according to claim 12, wherein the valve vane (6, 51) covers at least one opening (15) in the casing part (4) under formation of a valve (6, 15, 51, 15) in the one end position (A), and wherein this opening (15) is released in the second end position (B).

18. The valve vane according to claim 12, wherein the dog follower (10) is part of a pressure-actuated control cylinder (30), disposed in the casing part (4), and controlling the motion of the valve vane (6).

19. The valve vane according to claim 12, wherein at least the surface region (13, 5, 19), passed over by the valve vane (6), during motion of the valve vane (6), of the casing part (4) is recessed into the casing part (4), relative to the surrounding surface (25) of the casing part (4) by a measure corresponding to at least the thickness (d) of the valve vane (6).

20. The valve vane according to claim 19, wherein the valve vane (6, 51) is covered on its side, disposed remote from the casing part (4), at least over one part, such as side parts (8, 20), of its longitudinal extension, by a further valve vane (17), which valve vane (17) forms a further valve (16, 17) with at least one further opening (16), disposed in the surrounding surface (25) of the casing part (4), and wherein the further valve (17) exhibits in the foundation projection an inner surface recess (7), wherein the opening (15) of the valve (6, 15, 51, 15) is disposed within said inner surface recess (7).

* * * * *